United States Patent [19]

Smith

[11] Patent Number: 5,024,649

[45] Date of Patent: Jun. 18, 1991

[54] BOWL HEAD ASSEMBLY

[75] Inventor: Clement V. Smith, Attleboro, Mass.

[73] Assignee: Bird Machine Company, South Walpole, Mass.

[21] Appl. No.: 238,761

[22] Filed: Aug. 30, 1988

[51] Int. Cl.[5] ..... B04B 11/08

[52] U.S. Cl. ..... 494/85; 494/58

[58] Field of Search ..... 494/85, 52, 53, 54, 494/55, 56, 58, 59; 210/781, 782

[56] References Cited

U.S. PATENT DOCUMENTS 3,795,361 3/1974 Lee .
3,885,734 5/1975 Lee .
3,934,792 1/1976 High .
4,037,781 7/1977 High .
4,167,243 9/1979 Jackson .
4,228,949 10/1980 Jackson .
4,240,578 12/1980 Jackson .
4,245,777 1/1981 Lavanchy .
4,298,160 11/1981 Jackson .
4,298,162 11/1981 Hohne .
4,411,646 10/1983 Cyphelly .
4,504,262 3/1985 Forsberg .
4,731,182 3/1988 High .

*Primary Examiner*—Robert W. Jenkins
*Attorney, Agent, or Firm*—Fish & Richardson

[57] ABSTRACT

A centrifuge bowl head including a bowl head plate, a bowl spoke attached to an outer circumference of the bowl plate, and a bowl spoke plow attached to the bowl spoke, the bowl spoke plow impinging upon a wearing material at an angle less than seventy-five degrees.

A bowl head further including a bowl head plow connected to the bowl head plate, the bowl spoke plow having an additional directing angle, the bowl spoke plow being of unitary construction and the bowl spokes defining discharge ports, the area of the bowl spokes forming a ratio with the area of the discharge ports to allow material under the bowl spokes to have an included angle of 120 degrees or less.

14 Claims, 4 Drawing Sheets

BOWL HEAD ASSEMBLY

BACKGROUND OF THE INVENTION

The present invention relates to decanter centrifuges and more specifically to bowl heads for decanter centrifuges.

Decanter centrifuges are used in many applications which produce abrasive materials. In these applications, solid abrasive material may pack in the case of the centrifuge; often to the point where it contacts the rotating solids discharge member, i.e. the bowl head, of the centrifuge. This abrasive material may then wear away projecting surfaces on the bowl head.

This problem has been addressed by attaching flat, hard faced or ceramic covered, wear resistent plates to the rotating solids discharged member. These plates, sometimes called plows, are arranged so that they impinge on the wearing material at an abrupt angle, i.e. between 75 and 90 degrees.

SUMMARY OF THE INVENTION

It has been discovered that providing a bowl head with a bowl spoke having a bowl spoke plow that impinges upon a wearing material at a sloping angle, i.e. an angle less than 75 degrees, substantially increases the lifespan of the bowl spoke plow. In preferred embodiments, the bowl head may include a bowl head plow, the bowl spokes may include an additional directing angle surface, the bowl spoke and the bowl spoke plow may be of unitary construction and the bowl spokes may define discharge ports, the area of the bowl spokes forming a ratio with the area of the discharge ports to allow material under the bowl spokes to have an included angle of 120 degrees or less.

These and other features and advantages will be apparent from the following description of a presently preferred embodiment, and from the claims.

DETAILED DESCRIPTION OF THE PREFERRED EMBODIMENT

We first briefly describe the drawing.

STRUCTURE

Figure 1:
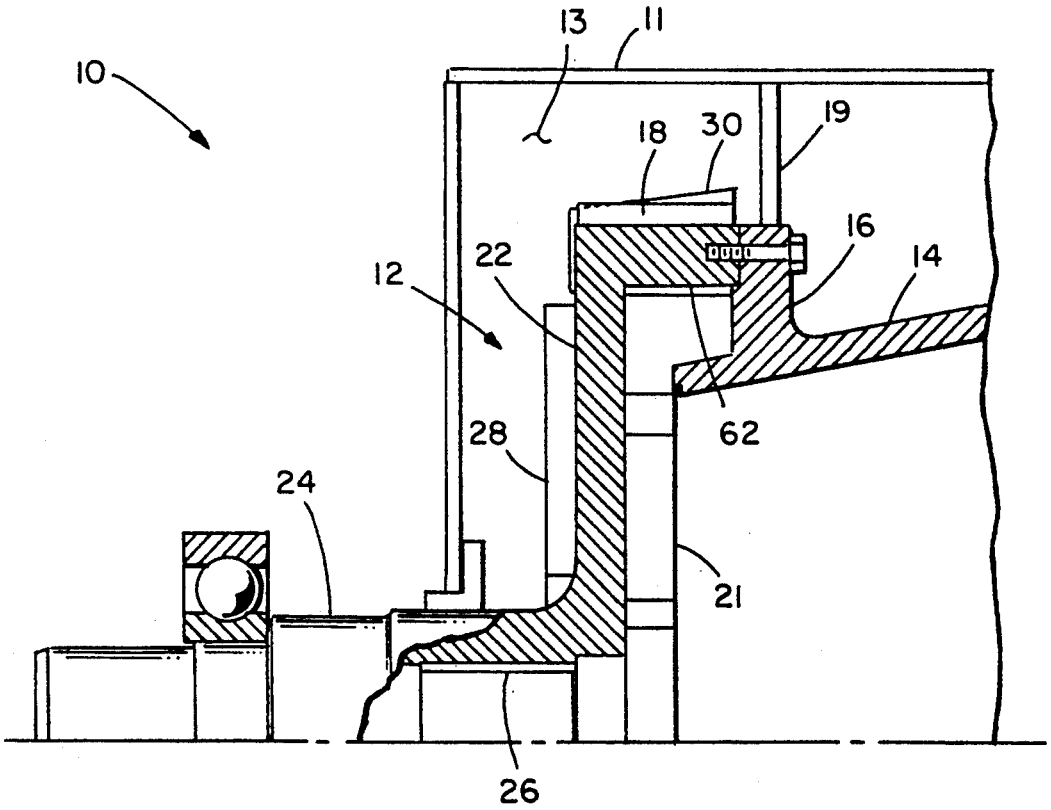
FIG. 1 is a cross-sectional view of a portion of a solid bowl centrifuge with a bowl head attached in accordance with the present invention.
Figure 2:
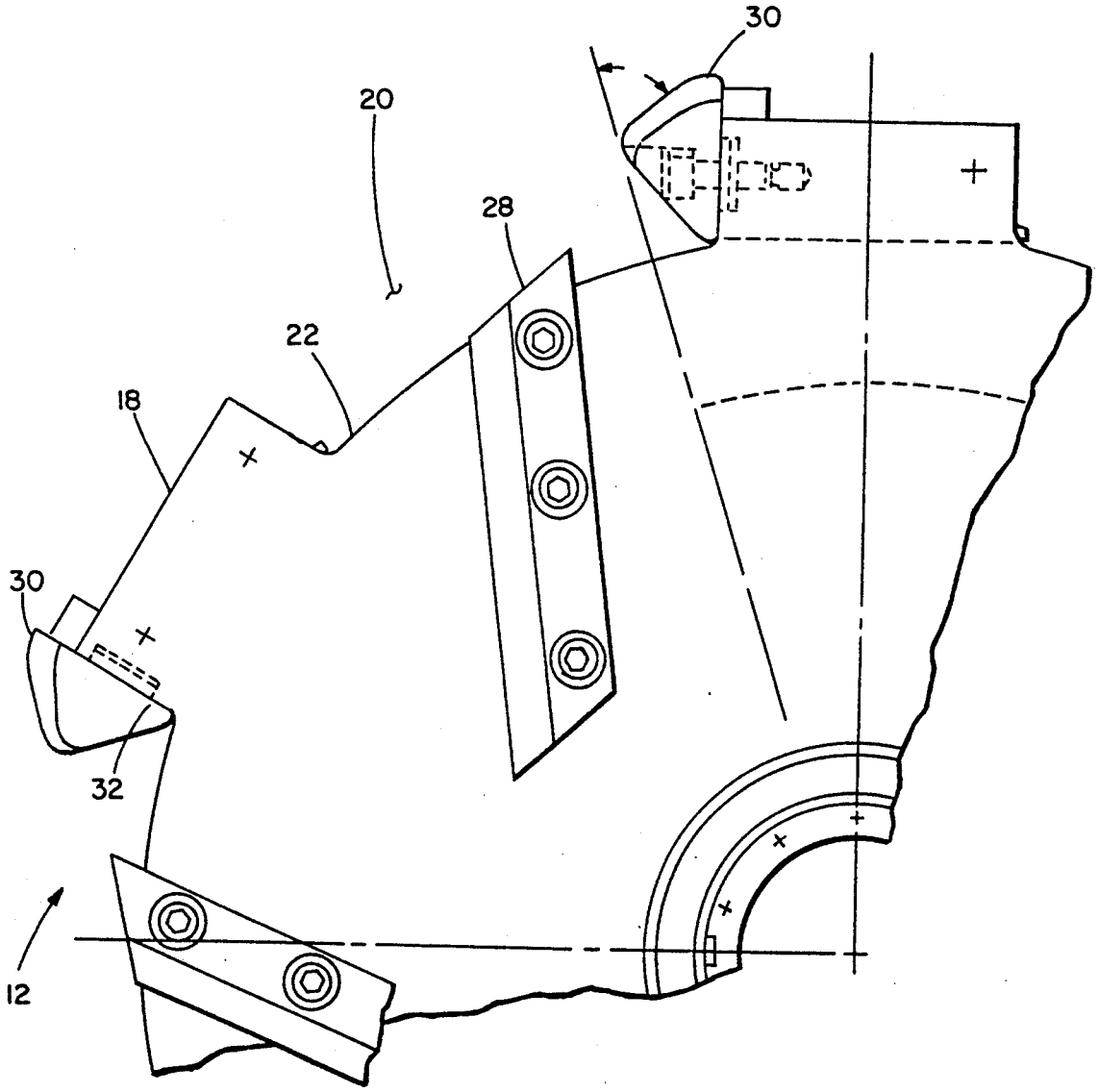
FIG. 2 is a partial view of the face of a bowl head in accordance with the present invention.

Referring to FIGS. 1 and 2, centrifuge 10 includes case 11 which surrounds and contains bowl 14. Solids bowl head 12 is attached to the solids discharge end of bowl 14. Bowl 14 has flanged members 16 to which bowl head 12 is attached. Case partition 19, extending inwardly from case 11 and minimally spaced from bowl 14, contains discharged material within a solids discharge portion 13 of case 11.

Bowl head 12 includes a circular flat plate 22 out of which bowl spokes 18 extend both axially and perpendicularly. Overflow dam 21 is attached to flat plate 22 and extends 360 degrees around bowl head 12. By attaching flange 16 to bowl spokes 18 of bowl head 12, discharge port 20 is defined through which solids may be discharged. Axis member 24 is attached to the center portion bowl head plate 22 and defines an axis through the center of bowl head plate 22. Axis member 24 includes bushing 26 which allows bowl head 12 to rotate freely. Bowl head plows 28 are attached to the surface of bowl head plate 26 and partially axially extend into discharge port 20. Bowl spoke plows 30 are attached to the leading surfaces 32 of bowl spokes 18.

Figure 3:
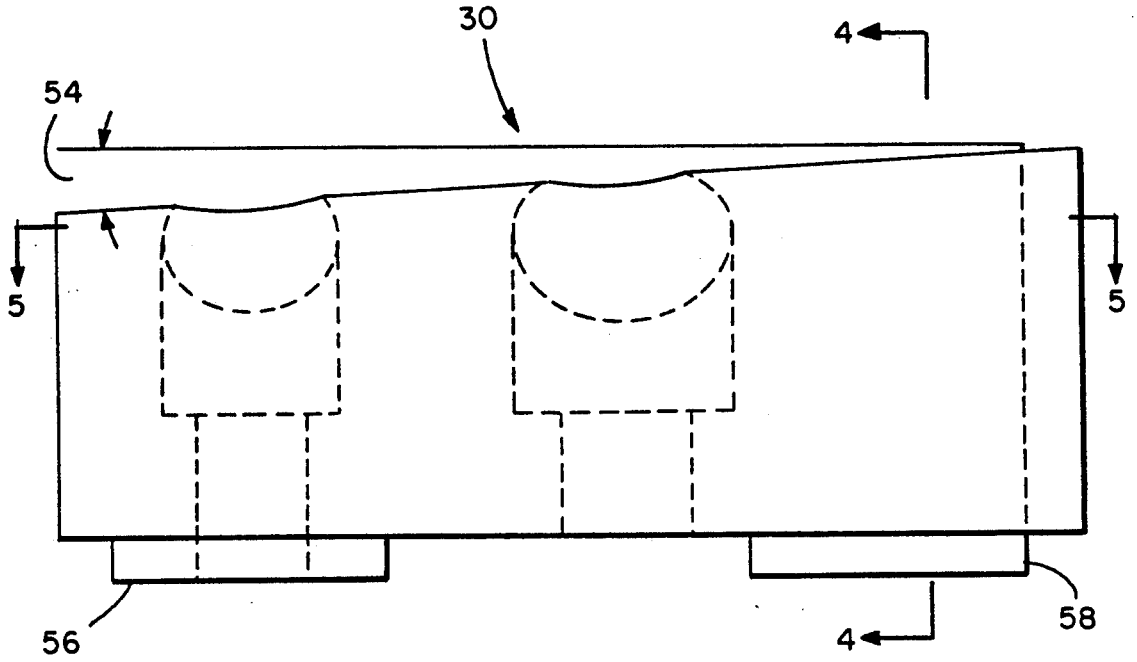
FIG. 3 is a side view of a bowl spoke plow of the FIG. 1 bowl head in accordance with the present invention.
Figure 4:
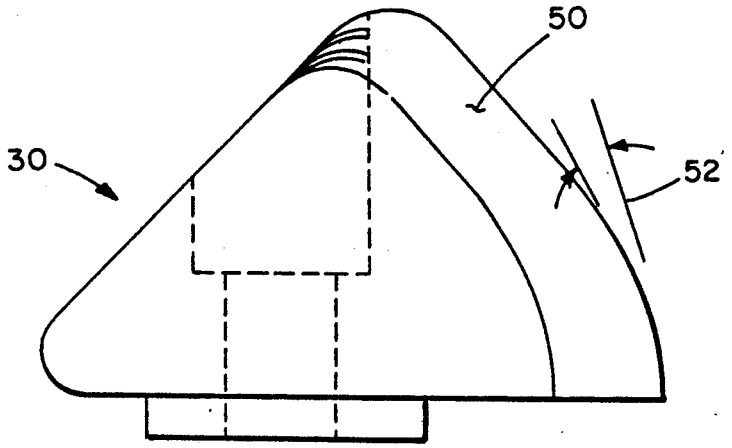
FIG. 4 is a view along lines 4—4 of the FIG. 3 bowl spoke plow.
Figure 5:
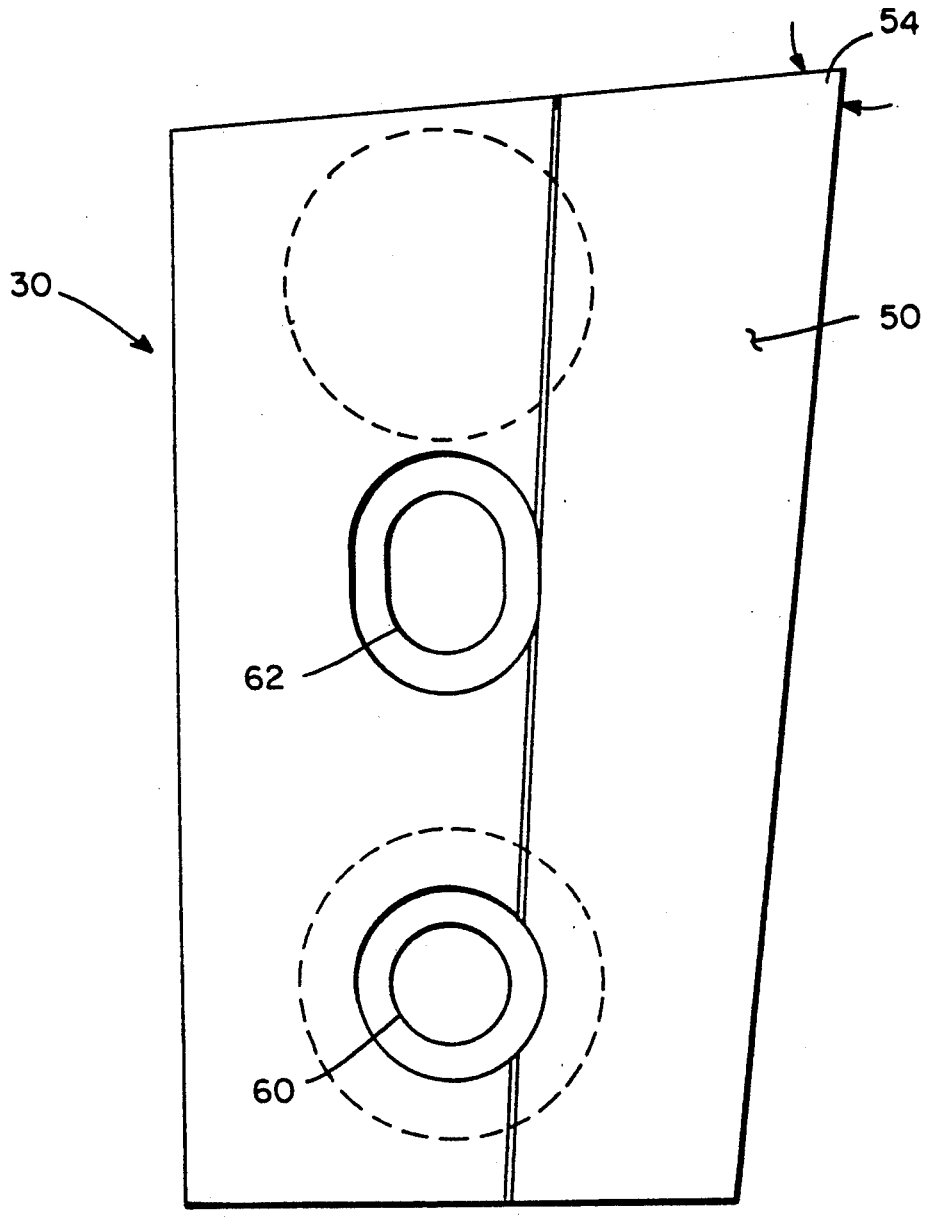
FIG. 5 is a view along 5–5 of the FIG. 3 bowl spoke plow.

Referring to FIGS. 3—5, bowl spoke plow 30 is composed of a wear resistant material, e.g., ceramic, various hard facings, i.e. metallic materials, and tungsten carbide, the composition of which depends upon centrifuge's 10 application. Bowl spoke plow 30 utilizes protrusions 56, 58 and screw holes 60, 62 to securely mount bowl spoke plow 30 to leading edge 32 of bowl spoke 18.

Bowl spoke plow 30 includes a plurality of angles which combine to form compound angle surface 50 which includes a first impingement angle 52 having a sloping angle, i.e. less than 75 degrees and preferably less than 20 degrees, and a second directing angle 54, e.g. 10 to 15 degrees. Compound angle surface 50 is curved to compensate for the shape of bowl 14.

OPERATION

Referring to FIGS. 1 and 2, centrifuge 10 utilizes conveyor (not shown) to separate and direct solids towards discharge port 20. Case 11 contains and directs solids discharged from bowl 14 and acts as a protective guard to bowl 14. During operation, abrasive solid material may accumulate on the inside surface of case 11 to contact plow head 12. At this point, bowl spoke plows 30 scrape a pathway through the accumulated material. Because there is a sloping angle of impingement between plow 30 and the abrasive material, bowl spoke plow 30 edges against the accumulated material and thus the impact upon bowl spoke plow 30 is lessened.

Additionally, as the accumulated material is scraped away, directing angle 54 directs the scraped material outwardly, away from bowl head 12. In this way, material does not accumulate between bowl spoke plow 30 and case partition 19.

In an application where large accumulations of material in case 11 are expected, bowl head plows 28 are used to direct the scraped material away from bowl head 12.

Although accumulated material that is in bowl head's 12 path is scraped away, material 60 which accumulates contiguous to inside surface 62 of bowl spoke 18 is allowed to remain because this material beneficially protects bowl spoke 18. The ratio between the cross-sectional area of bowl spokes 18 and the area of discharge ports 20 is designed so that the material 60 accumulates perpendicular to the cross-sectional area of bowl spoke 18 and forms an angle of repose such that the material surface is below the bowl discharge point, e.g. an included angle of less than 120 degrees. This provides bowl head 12 with a 360 degree discharge. Parameters used in determining the ratio between bowl spoke area and discharge point area include the number of bowl head spokes, the number of discharge ports, the distance between overflow dam 21 and bowl spokes 18, and the size of the bowl head.

OTHER EMBODIMENTS

In an alternate embodiment, bowl spoke plow 30 may be constructed as an integral part of bowl spoke 18. In this embodiment, the bowl spoke plow portion of the bowl spoke has a compound angle surface e.g. an angle of 40 to 45 degrees as its impingement angle and an angle of 10 to 15 degrees as its directing angle. To this surface is attached a flat wear element, e.g. a plate of wear resistant material. The edge of the flat wear element that contacts the abrasive material ultimately curves to conform to the inside surface of case 11.

Additionally, material 60 may be a preformed member, made e.g. of metal, which is attached to bowl head spoke 18, thereby stiffening bowl head 12, as well as protecting bowl spokes 18.

What is claimed is:

1. A centrifuge bowl head comprising, a bowl head plate, a bowl spoke attached to an outer circumference of said bowl head plate, said bowl spoke extending axially and perpendicularly from said bowl head plate, a bowl spoke plow attached to a first edge of said bowl spoke, said bowl spoke plow having a first surface, said first surface impinging on a wearing material at a first angle, said first angle being less than seventy-five degrees.

2. The centrifuge bowl head of claim 1 further comprising a bowl head plow attached to said bowl head plate, said bowl head plow diverting wearing material away from unprotected areas of said bowl head.

3. The centrifuge bowl head of claim 1 wherein said bowl spoke plow further comprises a directing surface having a second angle, said second angle directing the wearing material away from said bowl spoke plate.

4. The centrifuge bowl head of claim 3 wherein said bowl spoke plow first surface and said bowl spoke plow directing surface are in a single compound-angle surface.

5. The centrifuge bowl head of claim 1 wherein said bowl spoke and said bowl spoke plow are of unitary construction and further comprising, a sheet of wear resistant material attached to said first surface of said bowl spoke plow.

6. The centrifuge bowl head of claim 1 wherein said first angle is less than twenty degrees.

7. A bowl spoke plow comprising, a connecting surface being configured for connection to a bowl spoke extending substantially axially and perpendicularly from a bowl head plate and an impingement surface, said impingement surface being configured to contact an abrasive material at an angle less than seventy-five degrees.

8. The bowl spoke plow of claim 7, further comprising, a directing surface, said directing surface configured such that when said bowl spoke plow is connected to said bowl spoke, said directing surface directs material away from said bowl spoke.

9. The bowl spoke plow of claim 7 wherein said bowl spoke plow is constructed of a material selected from the group consisting of ceramic, hard facings, and tungsten carbide.

10. The bowl spoke plow of claim 7 wherein said angle is less than twenty degrees.

11. A bowl spoke plow comprising, a connection surface being configured for connection to a bowl spoke extending substantially axially and perpendicularly from a bowl head plate, and a directing surface, said directing surface being configured such that when said bowl spoke plow is connected to said bowl spoke, said directing surface directs material away from said bowl spoke.

12. A centrifuge bowl head comprising, a bowl head plate, a plurality of bowl spokes contiguous with and attached to an outer circumference of said bowl head plate, said plurality of bowl spokes extending axially and perpendicularly from said bowl head plate, said bowl spokes having a cross-sectional bowl spoke area, and said plurality of bowl spokes defining a plurality of discharge ports, said plurality of discharge ports having a discharge port area, said bowl spoke area forming a ratio to said discharge port area such that material contiguous to said bowl spokes and perpendicular to said bowl spoke area forms an included angle of 120 degrees or less.

13. The centrifuge bowl head of claim 12 wherein said material is preformed and attached to each of said plurality of bowl spokes.

14. The centrifuge bowl head of claim 12 wherein said material accumulates against said bowl spoke.

* * * * *

UNITED STATES PATENT AND TRADEMARK OFFICE

CERTIFICATE OF CORRECTION

PATENT NO. : 5,024,649

DATED : June 18, 1991

INVENTOR(S) : Clement V. Smith

It is certified that error appears in the above-indentified patent and that said Letters Patent is hereby corrected as shown below:

Column 2, line 4: after "portion" please insert -- of --.

Signed and Sealed this

Fourth Day of January, 1994

*Attest:*

BRUCE LEHMAN

*Attesting Officer*

*Commissioner of Patents and Trademarks*